United States Patent [19]

Morishita et al.

[11] Patent Number: 4,825,095

[45] Date of Patent: Apr. 25, 1989

[54] STARTER MOTOR

[75] Inventors: Akira Morishita; Shuzo Isozumi, both of Hyogo, Japan

[73] Assignee: Mitsubishi Denki Kabushiki Kaisha, Tokyo, Japan

[21] Appl. No.: 203,364

[22] Filed: May 27, 1988

[30] Foreign Application Priority Data

May 27, 1987 [JP] Japan ..... 62-134291
Jun. 17, 1987 [JP] Japan ..... 62-151666

[51] Int. Cl.[4] ..... F02N 15/06

[52] U.S. Cl. ..... 249/48; 74/7 A; 123/179 M

[58] Field of Search ..... 290/48, 38 R; 123/179 R, 179 M; 74/6, 7 R, 7 A

[56] References Cited

U.S. PATENT DOCUMENTS 4,604,907 8/1986 Morishita et al. ..... 74/7 A X
4,661,715 4/1987 Volino ..... 290/48
4,737,654 4/1988 Horishita et al. ..... 290/48

FOREIGN PATENT DOCUMENTS 52-9735 1/1977 Japan ..... 290/48

*Primary Examiner*—William M. Shoop, Jr.
*Assistant Examiner*—W. E. Duncanson, Jr.
*Attorney, Agent, or Firm*—Sughrue, Mion, Zinn, Macpeak and Seas

[57] ABSTRACT

An engine starter motor includes a stopper member having an outer diameter larger than an outer diameter of an output shaft of the starter motor and adapted to be detachably threaded to a front end portion of the output shaft, a front end of the stopper member being behind a front end of a pinion when fully retracted, a land portion formed on an inner surface of the pinion, the land portion being engaged with a rear end of the stopper member when the pinion is moved forwardly by a predetermined distance, and a bearing fixedly supported by the inner surface of the pinion and supporting the output shaft slidably, the bearing being positioned to receive a reactive force exerted on the output shaft.

4 Claims, 3 Drawing Sheets

STARTER MOTOR

BACKGROUND OF THE INVENTION

The present invention relates to a starter motor of an overhang type structure for starting an engine and, particularly, to an improvement of a pinion stopper thereof.

FIG. 6 is a cross section of a conventional engine starter motor having an overhang structure, in which a stopper 11 is assembled to an output shaft 15 of the motor through a ring 6. A pinion 17 is formed on an outer peripheral surface of the output shaft 15 and is assembled to an over-running clutch 14.

A bearing 9 is supported by an inner periphery of the pinion 7 and receives a reaction force from the output shaft 5. The inner peripheral surface of the pinion 17 is formed with a step portion 7*a* which serves to restrict a movement of the pinion 17 by a contact with the stopper 11.

A bearing 8 is received in and supported by a recess of a front bracket 10, which supports the pinion 17 slidably. A magnet switch 1 is disposed on a rear end of the front bracket 10 and a plunger 2 is arranged on an inner surface side of the switch 1. The plunger 2 functions to move the over-running clutch 4 forward through a lever 3.

In operation, when a voltage is applied to the magnet switch 1, the plunger 2 is attracted to move the over-running clutch 14 forward through the lever 3 to thereby move the pinion 17 through the bearing 8 so that a teethed portion of the pinion 17 meshes with a ring gear of an engine (not shown).

A distance along which the pinion 17 can move is restricted by a contact between the inner step portion 7*a* of the pinion 17 and the stopper 11.

In order to assemble the stopper 11 to the output shaft 2, it is necessary to protrude a front end portion of the stopper 11 slightly from the pinion and a front end of the output shaft 12 protrudes from the pinion end, necessarily, resulting in a total length of the starter motor large enough to make the assembling thereof to the engine difficult. Further, a freedom of design of the starter motor is restricted by the fact that the stopper 11 is assembled to the output shaft 5 through a ring 6, causing a reduction of an outer diameter of the stopper 11 to a certain value to be impossible in view of mechanical strength thereof and, therefore, in order to keep the strength of root portion of pinion teeth, it is very difficult to reduce the number of teeth of the pinion 17. Further, the assembling and disassembling of the stopper 11 with respect to the output shaft is complicated and troublesome.

SUMMARY OF THE INVENTION

An object of the present invention is to provide a starter motor which is short in total length, easy to assemble to an engine and has a pinion having teeth which can be reduced and a stopper which can be easily assembled and disassembled with respect thereto.

The starter motor according to the present invention includes a bolt screwed to a front end of an output shaft of the motor and having a diameter of a rear portion to be contact with the front end of the output shaft larger than an outer diameter of the output shaft, a pinion slidable forwardly over the bolt to a position defined by the rear portion of the bolt a front end of which is behind a front end of the pinion and a bearing supported by an inner periphery of the pinion for supporting a portion of the output shaft behind the bolt thereon.

The bolt screwed to the front end of the output shaft and having the front end always behind the front end of the pinion serves as a stopper and the bearing serves to exclude a bending moment to be exerted on the output shaft when the pinion whose front end is a front end of the starter motor is moved forwardly.

DETAILED DESCRIPTION OF THE PREFERRED EMBODIMENTS

Figure 1:
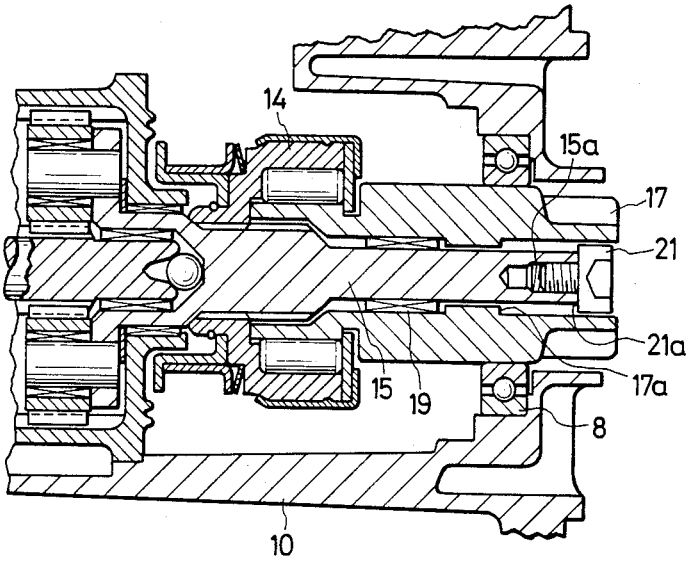
FIG. 1 is a cross section of a starter motor according to an embodiment of the present invention.
Figure 6:
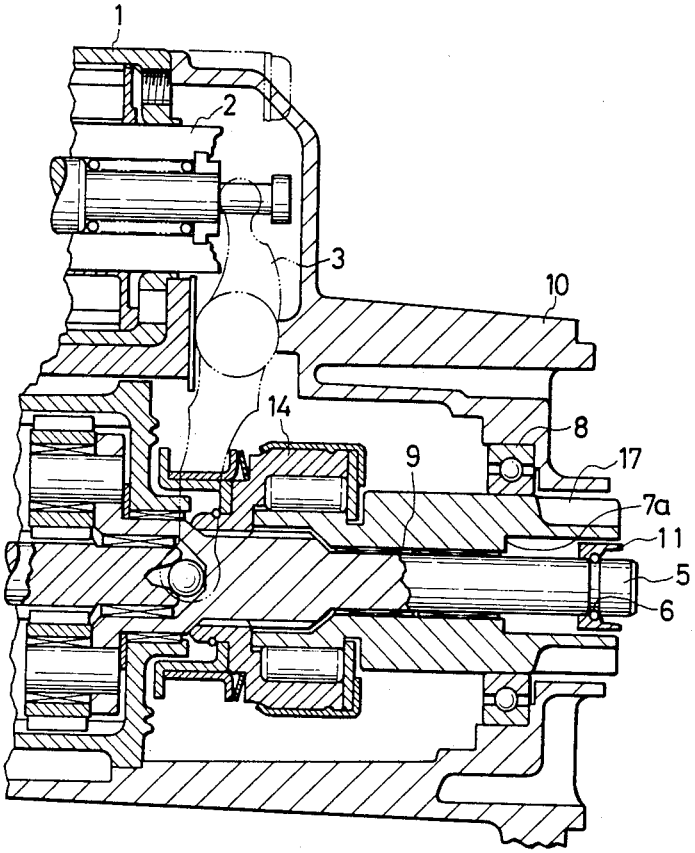
FIG. 6 is a cross section of a conventional starter motor.

In FIG. 1, an embodiment of the present invention shown in cross section includes similar components to those of the conventional starter motor shown in FIG. 6 depicted by same reference numerals. Therefore, details thereof are omitted in the following description for avoidance of duplication. According to the present invention, a front end portion of an output shaft 15 is formed with a female thread 15*a* into which a bolt 21 is screwed. The bolt 21 has a diameter larger than that of the output shaft 15 and serves as a stopper to be engaged with a land portion 17*a* formed on an inner surface of a pinion 17 arranged arround the output shaft 15 to restrict a forward movement of the pinion 17 over the output shaft 15.

A bearing 19 is provided behind the land portion 17*a* and supported by the inner surface of the pinion 17, by which the output shaft 15 is supported slidably rotatably. The position of the bearing 19 with respect to the output shaft 15 is defined such that it is behind the female thread 15*a* of the output shaft 15 when the pinion 17 is fully moved forwardly, as shown in FIG. 2.

The land portion 17*a* of the pinion 17 mounted on an over-running clutch 14 opposes to a rear face 21*a* of the bolt 21 and the forward movement of the pinion 17 is restricted when the land portion 17*a* engages with the rear face 21*a* of the bolt 21.

Figure 2:
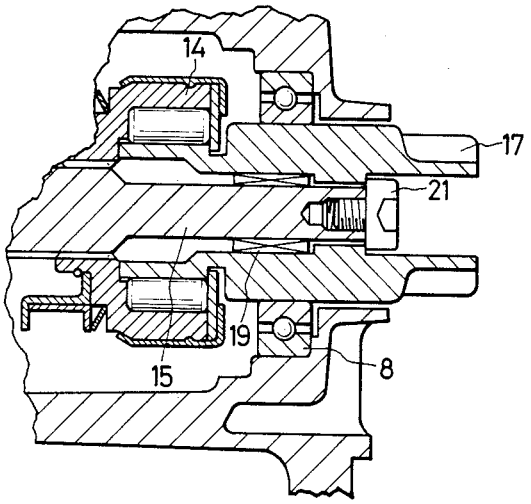
FIG. 2 is a cross section of a pinion shown in FIG. 1 when moved forwardly.

A bearing 8 is supported by a front bracket 10 and other components such as a lever 3, a magnet switch 1 etc. which are shown in FIG. 6 are omitted in FIG. 2.

In operation, when a voltage is applied to the magnet switch 1, a plunger (not shown) is attracted to rotate the lever to thereby move the over-running clutch 14 forwardly, as shown in FIG. 2. A portion of the pinion 17 which has no teeth slides through the bearing 8 provided in a recess of the front bracket 10 to establish a meshing relation between the pinion 17 and a ring gear of an engine.

A distance along which the pinion 17 can move is determined by a distance between the land portion 17*a* of the pinion 17 and the rear face 21*a* of the bolt 21.

Figure 3:
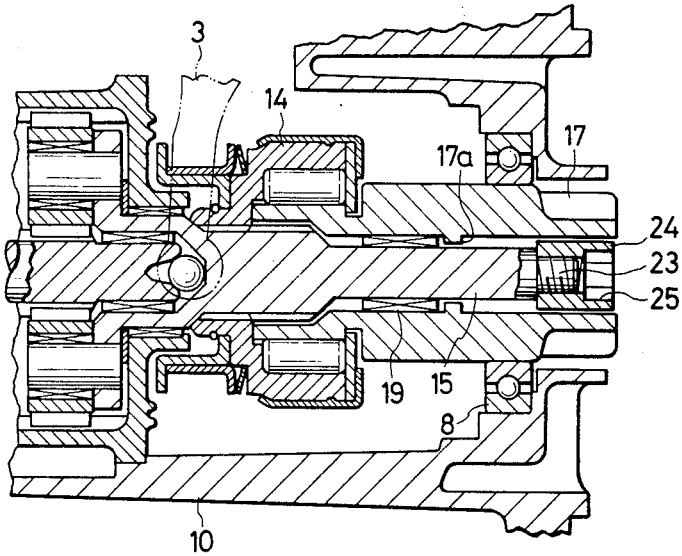
FIG. 3 is a cross section of another embodiment of the present invention.
Figure 4:
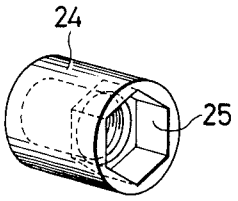
FIG. 4 is a perspective view of a main portion of the starter motor shown in FIG. 3.
Figure 5A:
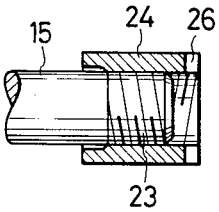
FIGS. 5 *a* and 5 *b* are a cross sectional and a front views of the main port s in FIG. 4, respectively.
Figure 5B:
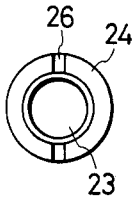

FIG. 3 shows another embodiment of the present invention which differs from that shown in FIG. 1 in that a nut 24 having female thread 23 is used instead of the bolt 21. That is, as shown in FIG. 3 and FIG. 4 which shows the nut 24 in detail, a front end portion of the output shaft 15 is threaded to which the nut 24 having an outer diameter larger than the diameter of the output shaft 15 is screwed. The nut 24 is formed in a front end thereof with a recess 25 for receiving a hexagonal screw driver head. FIG. 5*a* shows another nut having slots 26 which are suitable to receive a minus screw driver.

The stopper in the form of the bolt 21 in FIG. 1 or the nut 24 in FIG. 3 can be easily mounted on or demounted from the front portion of the output shaft by merely turning a suitable screw driver inserted into the recess 25 or 26. Since the stopper does not protrude from the front end of the pinion in a fully retracted state, a total length of the starter motor can be made shorter compared with the conventional motor and easily mounted on the engine regardless of existence of a fly-wheel etc. The nut 4 may be not always circular. It may be polygonal so long as it can provide a shoulder to be engaged with the land portion of the pinion. Due to the use of bolt or nut which is hig mechanical strength as the stopper, it is possible to make the outer diameter of the stopper smaller as well as the pinion and to reduce the number of pinion teeth.

Although the statrter motor having a reduction mechanism has been shown, it may one having no such mechanism.

What is claimed is:

1. An engine starter motor including a motor, an output shaft, an over-running clutch adapted to be moved forwardly upon application of a voltage to a magnet switch and a pinion supported by said over-running cltutch slidably on and along said output shaft, comprising a stopper member having an outer diameter larger than an outer diameter of said output shaft and adapted to be detachably threaded to a front end portion of said output shaft, a front end of said stopper member being behind a front end of said pinion when fully retracted, a land portion formed on an inner surface of said pinion, said land portion being engaged with a rear end of said stopper member when said pinion is moved forwardly by a predetermined distance, and a bearing fixedly supported by said inner surface of said pinion and supporting said output shaft slidably, said bearing being positioned to receive a reactive force exerted on said output shaft.

2. The engine starter motor as claimed in claim 1, wherein a position of said bearing is behind said stopper member when said pinion is fully moved forwardly.

3. The engine starter motor a claimed in claim 2, wherein said stopper member comprises a bolt adapted to be screwed into a female thread formed in said front end of said output shaft.

4. The engine starter motor as claimed in claim 2, wherein said stopper member comprises a nut to be screwed onto a male thread formed on said front portion of said output shaft.

* * * * *